United States Patent [19]

Zelinski

[11] Patent Number: 4,696,461

[45] Date of Patent: Sep. 29, 1987

[54] PORTABLE, COLLAPSIBLE STAND FOR USE IN CLEANING A MUZZLE LOADING RIFLE OR A MUZZLE LOADING SHOTGUN

[76] Inventor: Roger M. Zelinski, R.D. #1, Little Falls, N.Y. 13365

[21] Appl. No.: 632,609

[22] Filed: Jul. 19, 1984

[51] Int. Cl.[4] ..... B25B 11/00

[52] U.S. Cl. ..... 269/16; 211/64; 269/287; 269/901; 269/909

[58] Field of Search ..... 269/16, 901, 287, 15, 269/909, 329; 211/64; 248/188.6, 188.7, 150

[56] References Cited

U.S. PATENT DOCUMENTS

| | | | |
|---|---|---|---|
| 2,482,979 | 9/1949 | Isakson | 248/188.7 |
| 3,952,878 | 4/1976 | Gorham | 211/64 |
| 4,144,971 | 3/1979 | Balibrea | 211/64 |
| 4,232,919 | 11/1980 | Stewart | 211/64 X |

FOREIGN PATENT DOCUMENTS

| | | | |
|---|---|---|---|
| 17657 | of 1893 | United Kingdom | 211/64 |

*Primary Examiner*—Frederick R. Schmidt
*Assistant Examiner*—Steven P. Schad

[57] ABSTRACT

A stand to be used when cleaning a muzzle loading rifle or a muzzle loading shotgun. It consists of a large, stable base with an upright member attached to it, and with a barrel receiving mechanism attached to the top of said upright member. The stand will then securely support the gun barrel in a vertical or near vertical position which greatly facilitates the cleaning operation. The stand is also designed to be easily collapsible to a significantly more compact form for storage.

1 Claim, 3 Drawing Figures

FIG. II
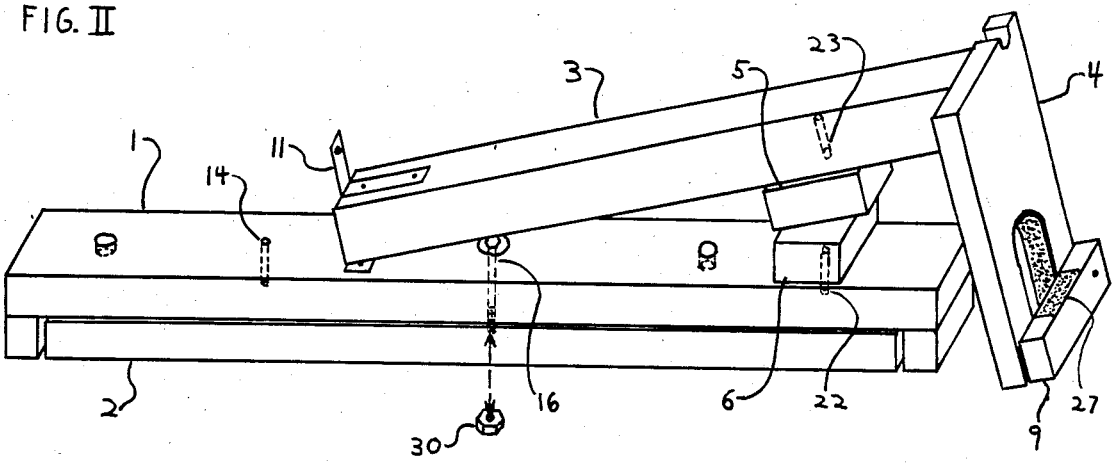
FIG. I
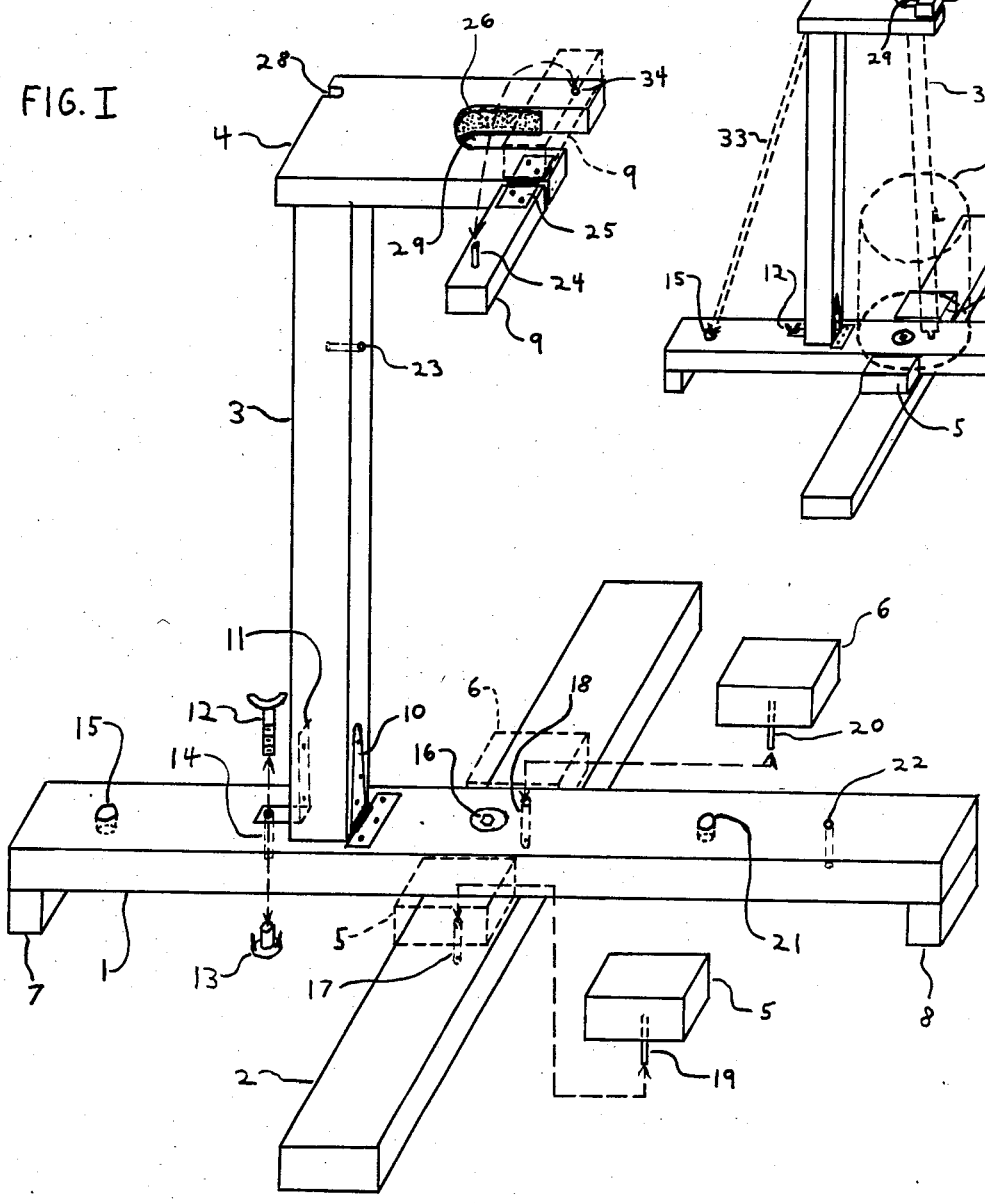
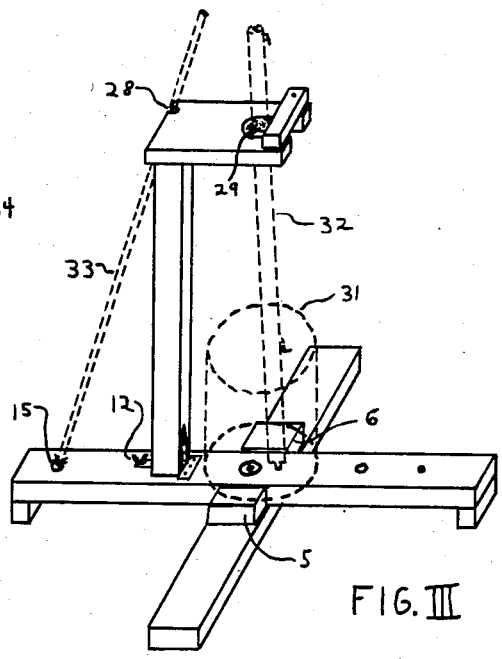
FIG. III

PORTABLE, COLLAPSIBLE STAND FOR USE IN CLEANING A MUZZLE LOADING RIFLE OR A MUZZLE LOADING SHOTGUN

BACKGROUND

This invention is designed to make the cleaning of a muzzle loading rifle or a muzzle loading shotgun a significantly easier process than it normally is. For the rest of this discussion, it should be understood that when I say muzzle loading rifle, it is also meant to include muzzle loading shotgun, as the cleaning procedures and hence the operation of this stand are similar for both types of firearms.

A muzzle loading rifle, as the name implies, is a rifle that is loaded through the muzzle. Likewise, the cleaning of the barrel must also be done from the muzzle end. The cleaning procedure is complicated somewhat by the fact that the breech end of the barrel is plugged except for a small diameter hole through which ignition of the powder charge is achieved. It is also imperative that the barrel be thoroughly cleaned after every shooting session, as the blackpowder which is used is highly corrosive and would quickly rust the barrel if not removed.

There are two ways of cleaning a muzzle loading rifle. One invovles the use of blackpowder solvent and the procedure is similar to that of cleaning a modern day firearm. It is however, complicated by the plugged breech and it is very difficult to do a thorough job, particularly around the sharp corners and recesses. The fumes of the solvent are also considered most unpleasant by many people and the procedure can be very time consuming. While my stand could be used for this procedure if one so desired, and while it may provide some convenience, it is primarily designed to be used in the following procedure. A more thorough, less odoriferous, and much recommended and preferred procedure involves the use of hot, soapy water. The process used in this procedure is as follows. A bucket is filled to a depth of several inches with hot, soapy water. The breech end of the barrel is inserted into the bucket and allowed to rest on the bottom. A pathc, premoistened with the hot, soapy water, is then inserted into the muzzle, forced down to the bottom and then withdrawn or nearly withdrawn with the cleaning rod. What occurs during this process is the patch forms a nearly airtight seal inside the barrel and when it is withdrawn, hot, soapy water in the bucket is drawn in through the nipple hole in the breech end and right up to the top of the barrel. The action of the hot, soapy water and the patch thoroughly cleans the barrel and the small recesses after only several strokes. The process is then repeated with hot, clear water to rinse the barrel out.

There are however, some disadvantages to the hot, soapy water procedure and it is these disadvantages which I seek to alleviate with my stand. The first disadvantage is that once the cleaning process is begun, one must continue to hold the barrel with one hand at all times. Letting go of the barrel would allow it to fall, thereby spilling the water all over the floor, marring the finish of the barrel, and perhaps breaking the sights on the barrel and gouging the floor. Leaning the barrel against a table or chair is generally unsatisfactory for sooner or later the bucket, barrel, table, or chair will accidentally be nudged and the afore mentioned calamity will occur. Therefore, holding on to the barrel at all times leaves one with only one hand free to manipulate the patches, cleaning rod, and bucket of hot, soapy water and then hot, clear water. While it is possible to do this, it can be exceedingly difficult and can try one's patience. Another disadvantage is caused by the temperature of the water. Generally speaking, the hotter the water is, the better the results will be. There are two reasons for this. The first is that the hotter the water is, the faster and more effetively it will clean the barrel. The second is that the hot water also heats the barrel up. This in turn causes the barrel to dry much faster when the cleaning process is finished, thereby greatly reducing the likelihood of rusting which would occur if the barrel remained wet for any length of time. Holding on to the barrel when using very hot water can cause at the least, extreme discomfort and at the most, extreme burns, so it is obviously something to be avoided if at all possible.

The stand that I have invented eliminates all of the afore mentioned disadvantages of the hot, soapy water procedure for cleaning a muzzle loading rifle.

SUMMARY OF THE INVENTION

My invention is designed to hold the barrel of a muzzle loading rifle securely during the cleaning operation, thereby leaving both hands free to manipulate the cleaning apparatus. It eliminates the possibility of dropping the barrel and it also allows the use of very hot water since one need not worry about being burned. It can be set up on any reasonably level surface so the barrel can be cleaned wherever it is convenient to do so. The stand also collapses into a compact form for storage.

BRIEF DESCRIPTION OF THE DRAWINGS

FIG. I is a perspective view of the stand as it is be ing opened and set up for use.

FIG. II is a perspective view of the stand in its collapsed form, ready for storage.

FIG. III is a perspective view of the stand fully assembled and in use.

DETAILED DESCRIPTION OF THE INVENTION

Approximate dimensions will be given in the following description. It should be understood that they are the dimensions that I have found most appropriate for the broadest range of muzzle loading rifles and the materials used in the construction of this stand. However, the dimensions and materials can be modified for specific applications without departing from the broad interest and intent of this invention.

I shall give the general dimensions of the stand here so that the reader will have a basic idea of the overall size of the invention. The base opens to approximately 28 inches by 31 inches and base members 1 and 2 are each approximately $1\frac{3}{8}$ inches thick. The overall height is approximately $24\frac{3}{4}$ inches and barrel receiving space 29 measures approximately 2 inches wide by $2\frac{1}{2}$ inches long. Members 1 through 9 are made of wood. The bracket, hinges, and other hardware items are made of metal.

Referring now to the drawings, in FIG. I I have shown my stand as it is being opened and set up for use. The two primary members of the base, base members 1 and 2, are shown pivoted to their fully open position. They pivot about bolt 16 which will be described more fully in FIG. II. In use, base member 2 rests flat on the floor and base member 1 rests horizontal to the floor, but a given distance above the floor, that distance being equal to the thickness of base member 2. Legs 7 and 8 are securely fastened to basemember 1 so as to form a base that will rest firmly on the floor and will not wobble. Also important in the functioning of the base are blocks 5 and 6. Emerging perpendicularly from the center of the bottom of each block 5 and 6 is a pin, 19 and 20 respectively. When base member 2 is pivoted to a right angle with base member 1, said pins 19 and 20 wil fit into holes 17 and 18 in base member 2. The function of said blocks 5 and 6 is twofold. First, when inplace in the open stand, they prevent basemembers 1 and 2 from accidentally pivoting into the closed position. Second, they provide a larger, more stable base for bucket 31 to rest upon. The use of said bucket 31 will be described more fully in FIG. III.

There are several holes drilled in base member 1. They are all perpendicular to the top surface of base member 1 and their functions are as follows. Hole 15 is approximately $\frac{7}{8}$ inch in diameter and drilled to a depth of approximately $\frac{1}{2}$ inch. Its purpose is to receive one end of cleaning rod 33 as shown in FIG. III. Hole 14 is approximately $\frac{1}{4}$ inch in diameter and is drilled completely through base member 1. It is designed to receive thumbscrew 12 as said thumbscrew passes through bracket 11. The bottom $\frac{1}{2}$ inch or so of said hole 14 must be drilled somewhat larger in order to accept T-nut 13 which is used to hold said thumscrew 12 in place. Once said T-nut 13 is put in place, it may be left there permanently as there is no reason to remove it in the normal operation of the stand. Hole 21 is approximately $\frac{7}{8}$ inch in diameter and is drilled to a depth of approximately $\frac{1}{2}$ inch. Its purpose is to receive the breech end of the barrel 32 when changing said bucket 31 of water, thereby preventing said barrel 32 from slipping off the stand. Hole 22 is approximately 3/16 inch in diameter and is drilled completely through base member 1. Its purpose is to receive said pin 19 or 20 of said block 5 or 6 when the stand is folded for storage and will be more fully described in FIG. II.

Upright member 3 is attached perpendicularly to the base formed by base members 1 and 2. It is connected to the bse by T-hinge 10 which is permanently attached to both upright member 3 and base member 1. Upright member 3 is also connected to the base by L-bracket 11 which is permanently attached to upright member 3 and temporarily attached to base member 1 by said thumbscrew 12. Hole 23 is drilled in upright member 3 and is approximately 3/16 inch in diameter and is approximately 1 inch deep. Its purpose is to receive said pin 19 or 20 of said block 5 or 6 when the stand is folded for storage and will be more fully described in FIG. II.

The barrel retaining mechanism is made up primarily of barrel retaining member 4 and barrel retainer 9. Barrel retaining member 4 is securely, permanently attached perpendicularly to the top of upright member 3. Barrel retainer 9 is attached to barrel retaining member 4 by hinge 25. Said barrel retainer 9 is shown in the open position by the solid line figure and in the closed position by the dotted line figure. Barrel retainer pin 24 is securely mounted perpendicularly in said barrel retainer 9 and fits looselyinto hole 34 which is drilled in barrel retaining member 4. U-shaped barrel receiving space 29 can be lined with cloth, foam, or some other type of padding 26 to protect the finish of the barrel. Padding 27 can also be placed on said barrel retainer 9 as shown in FIG. II for the same reason. U-shaped slot 28 is cut into barrel receiving member 4 to receive the ramrod 33 as shown in FIG. III.

FIG. II shows the stand in its collapsed form, ready for storage. As can be seen, base members 1 and 2 pivot around bolt 16 and countersunk nut 30 until they are parallel. The pins 19 and 20 of said blocks 5 and 6 fit into said holes 22 and 23. Said blocks 5 and 6 are equally dimensioned and are thus interchangeable. Once said thumbscrew 12 is removed from said hole 14 and said L-bracket 11, upright member 3 can pivot on said hinge 10 and fold into the position shown.

FIG. III shows the stand fully assembled and in use. Bucket 31 of hot, soapy water or hot, clear water rests on the bse. Barrel 32 is positioned with the breech end in said bucket 31 and with the muzzle end securely held in said barrel receiving space 29. When changing patches or the bucket of water, the cleaning rod 33 can be positioned as shown in said hole 15 and said slot 28 so that it also is secure from falling.

The above description represents only one preferred form and application of my invention and shall not be construed as limiting the ways in which this invention may be practiced, but shall be inclusive of any modifications or variations that do not depart from the broad interest and intent of this invention.

Having described my invention, I claim:

1. A portable stand for use in cleaning thebarrel of a muzzle loading rifle or a muzzle loading shotgun comprising a base which is of adequate dimensions to provide substantial stability to said stand and which is formed by two members which pivot about a central axis such that when in use, said members are at approximate right angles with one another and in storage, said members are approximately parallel with one another; means adapted to engage said membes to lock them at substantially right angles with one another and to provide a larger support surface for supporting a bucket used in cleaning the barrel; an upright member attached to said base via hinged means such that when in use, said upright member is approximately perpendicular to said base and ins torage, said upright member folds to approximately lie along side said base; and a barrel receiving mechanism attached to said upright member wherein said barrel receiving mechanism comprises a generally U-shaped member and a latch which closes off the open end of said U-shaped member, said latch virturally insuring that the barrel cannot be forced from said barrel receiving mechanism except by the use of unwarranted force, said latch comprising an elongated member attached to one side of said U-shaped member via a hinge and further containing a barrel retainer pin which coincides with a hole on the other side of said U-shaped member; further said barrel receiving mechanism also contains another U-shaped slot for purposes of receiving a barrel cleaning rod.

* * * * *